United States Patent [19]

Tsoi-Hei Ma

[11] 4,034,028

[45] July 5, 1977

[54] VARIABLE VENTURI CARBURETOR

[75] Inventor: Thomas Tsoi-Hei Ma, Romford, England

[73] Assignee: Ford Motor Company, Dearborn, Mich.

[22] Filed: Jan. 26, 1976

[21] Appl. No.: 652,487

[30] Foreign Application Priority Data

Mar. 14, 1975 United Kingdom ..... 10693/75

[52] U.S. Cl. ..... 261/41 R; 261/44 R; 261/DIG. 56; 261/DIG. 78

[51] Int. Cl.[2] ..... F02M 9/14

[58] Field of Search .... 261/DIG. 60, DIG. 61–DIG. 63, 261/44 R, 41 R, 62, DIG. 56, DIG. 78

[56] References Cited

UNITED STATES PATENTS

| | | | |
|---|---|---|---|
| 1,152,173 | 8/1915 | Haegele | 261/44 R |
| 1,291,833 | 1/1919 | Godward | 261/44 R |
| 1,726,324 | 8/1929 | Udale | 261/62 |
| 1,813,866 | 7/1931 | Royce | 261/44 R |
| 1,818,928 | 8/1931 | Kreher | 261/DIG. 63 |
| 1,861,694 | 7/1932 | Gindele | 261/44 R |
| 1,969,638 | 8/1934 | Culp | 261/DIG. 78 |
| 1,979,918 | 11/1934 | Wahlmark | 261/44 R |
| 3,759,499 | 9/1973 | Lang | 261/41 D |
| 3,814,389 | 6/1974 | August | 261/DIG. 78 |
| 3,953,548 | 4/1976 | Knapp | 261/DIG. 78 |

FOREIGN PATENTS OR APPLICATIONS

| | | | |
|---|---|---|---|
| 133,175 | 10/1919 | United Kingdom | 261/DIG. 63 |

*Primary Examiner*—Tim R. Miles
*Attorney, Agent, or Firm*—Robert E. McCollum; Keith L. Zerschling

[57] ABSTRACT

A downdraft type carburetor having essentially conventional idle speed and main fuel metering systems has a throttle body or plug movable within a fixed area venturi to provide sonic flow at idle and part throttle operations; the plug is slidably mounted on a fuel tube extension of a centrally located main fuel discharge snout, and discharges fuel into a high velocity constricted area or throat formed between the plug and fixed area venturi.

5 Claims, 2 Drawing Figures

VARIABLE VENTURI CARBURETOR

This invention relates to a variable area venturi carburetor. A movable throttle body or annular plug is mounted in an otherwise conventional fixed area venturi choke carburetor. The throttle body is shaped to provide a convergent-divergent passage between the venturi and plug, and defines a variable annular throat. Fuel from a conventional metering system passes into the throttle body and is discharged into the variable area throat.

According to the invention, the variable area venturi carburetor has the following features:

a. A carburetor body is formed with an induction passage communicating with ambient air at one end and adapted to be connected to an engine inlet manifold at the opposite end;

b. an induction passage has a fixed choke or constricted area, the passage converging upstream of the choke and diverging downstream of the choke to define with it a fixed area venturi;

c. a main fuel passage extends into the induction passage and communicates with a fuel discharge tube that extends axially along the choke;

d. an elongated throttle body or plug is supported for axial sliding movement in the induction passage at its upstream end by engagement with the fuel tube;

e. a throttle control device is arranged for supporting the downstream end of the throttle body or plug for sliding movement and for displacing the throttle body between an idle position and a full throttle position downstream of the idle position;

f. the throttle body has a divergent portion merging into a convergent portion;

g. in its idle position the throttle body closely fits the induction passage;

h. as the throttle body is displaced towards the full throttle position a variable throat is opened between the widest part of the throttle body and the divergent portion of the induction passage; and i. the throttle body has internal passages which connect the fuel tube to the widest part of the throttle body for discharge of fuel into the variable throat.

Figure 1:
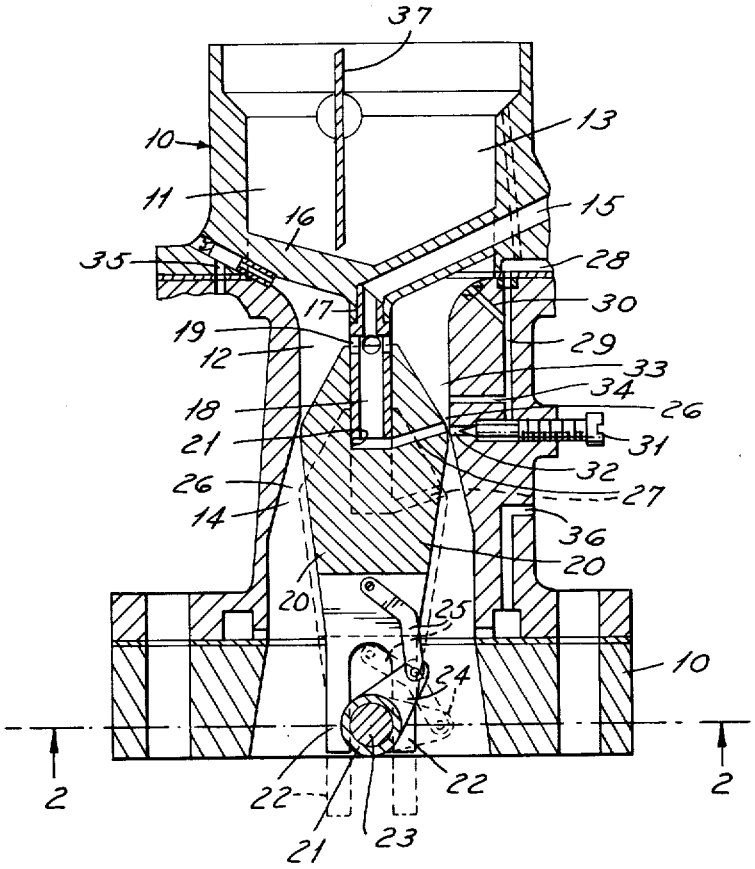
Figure 2:
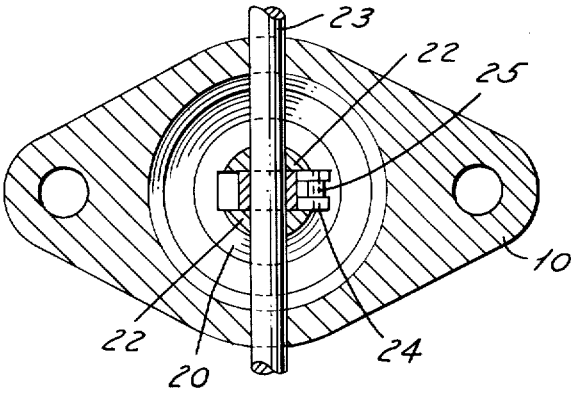

The invention will now be described with reference to the accompanying drawings, in which:

FIG. 1 is a vertical section through a downdraft variable area venturi carburetor embodying the invention; and FIG. 2 is a section along the line A—A in FIG. 1.

The carburetor of the invention is a modification of a conventional fixed jet or venturi downdraft carburetor. The carburetor comprises a body 10 formed with an induction passage 11 having a fixed venturi defined by a stationary or fixed constricted area choke section 12, a convergent portion 13 upstream of the fixed choke, and a divergent portion 14 downstream of the fixed choke. The upper end of the induction passage is connected to ambient air through a conventional air cleaner (not shown). The downstream end of the induction passage is adapted to be connected to the inlet manifold of a spark ignition internal combustion engine.

A main fuel passage 15 extends into the induction passage 11 from the carburetor body 10 and is supported by an integral spider 16. The downwardly directed snout 17 extends into the upstream side of the fixed choke 12. The main fuel passage 15 is supplied with fuel from a float chamber and main fuel jet system (not shown) in the conventional manner. The fuel level in the fuel is below the end of the snout 17.

The portions of the carburetor described above are conventional and thus it will be appreciated that the fuel metering is determined by the pressure in the fixed choke section 12.

A fuel tube 18 is fixed in the end of the snout 17 and extends axially along the fixed area venturi section 12 in a downward direction. Just below the snout 17, the fuel tube is formed with relatively large openings 19 which communicate the fuel snout with the venturi and thus ensure that fuel metering in the carburetor continues to be determined by the pressure depression in the fixed choke.

A throttle body or plug 20 is formed at its upstream end with an axial bore 21 which slidably receives the end of fuel tube 18. The lower downstream end of throttle body 20 is formed with four circumferentially spaced legs 22 that extend parallel to the axis of the induction passage 11. A throttle shaft 23 extends across the lower part of the induction passage between pairs of the legs 22 thereby locating the throttle body against movement transversely of the throttle shaft 23 but allowing sliding movement of the throttle body axially of the induction passage. A lever 24 is fixed to the throttle shaft 23 within the induction passage and fits closely between pairs of the legs 22 thereby laterally locating the lower part of the throttle body with respect to the axis of the induction passage, i.e., locating it against movement along the throttle shaft 23. A link 25 pivotally connects the end of the lever 24 to the throttle body 20 so that rotation of throttle shaft 23 produces vertical sliding movement of the throttle body 20.

FIG. 1 shows in full lines the throttle body 20 in its uppermost or engine idle speed position in which the throttle body closely fits the induction passage just below the fixed choke section 12. A small annular throat 26 for idle air is thus defined between the throttle body 20 and the carburetor body 10.

FIG. 1 shows in dotted lines the lowermost full throttle position of throttle body 20 in which the throat 26 has been opened to provide a larger annulus between the widest part shown of the throttle body 20 and the divergent portion 14 of the induction passage 11. The throttle body 20 upstream of its broadest portion has a divergent shape which merges into a convergent shape downstream of the broadest portion.

The movement of throttle body 20 thus controls the area and position of variable throat 26, the throat 26 moving upwardly and downwardly within the divergent portion 14 of the induction passage as the throttle shaft 23 is adjusted.

A number of fuel flow passages 27 connect the bore 21 in the throttle body to the variable area throat 26. A relatively large number of passages 27 are provided to ensure even distribution of fuel into the annular throat 26.

An idle system includes an idle fuel passage 28 connected to the fuel bowl (not shown). An idle mixture passage 29 is connected to idle fuel passage 28 and to the induction passage 11 upstream of the fixed choke 12 by a pilot system 30. An idle control screw 31 controls the flow volume of idle mixture from the idle mixture passage 29 to an idle discharge opening 32 which is located at the position of the variable throat 26 when the throttle body 20 is in the idle position shown in full lines. A progression or transfer opening 34 located just upstream of the variable throat and above the idle discharge opening 32 is connected to the idle mixture passage 29.

Although the locations of the idle discharge opening 32 and the progression hole or transfer opening 34 are different from those in conventional carburetors, the induction type fuel metering operation of the idle and progression system is in fact similar.

An acceleration fuel jet 35 is connected to a conventional accelerator pump (not shown) for providing additional fuel when the throttle is suddenly opened.

Passage 36 connects the induction passage downstream of the throttle body 20 to a conventional power valve system (not shown) which effectively increases the size of the main fuel jet (also not shown) when the manifold vacuum is low to give a richer mixture at full load.

A conventional choke plate 37 is used for cold starting. The plug and venturi walls defining the throat section 26 are so constructed and geometrically arranged as to provide sonic velocity to the flow through the throat during idle and part throttle operating conditions. That is, the fuel is discharged into the throat 26 where sonic flow conditions prevail at idle and part throttle thereby greatly improving fuel atomization and mixing. However, the metering of the fuel (except at idle when sonic flow always takes place in the throat) does not depend upon the pressure at the throat. Instead metering is determined by the subsonic flow velocity in the fixed choke or venturi 12. The lower pressure is communicated through openings 19 to passage 15 to provide the pressure depression for induction of the fuel down tube 15 and into snout 17. The metered fuel is then simply guided along the fuel tube 18 and the internal passages 21 and 27 to be discharged at the section of maximum relative velocity at the throat.

When the air flow is sonic at the throat the vacuum signal at the throat is then constant and the fuel metering is very stable because the fixed choke is then isolated from the transient pressure fluctuations in the manifold. When the air flow is below sonic at the throat, the fuel metering will still function properly in the same way as a conventional fixed choke carburetor.

The convergent-diverge flow passage defined between the throttle body 20 and the fixed venturi ensures that when flow at sonic velocity takes place through the variable throat 26 a supersonic region is created downstream of the throat followed by a shock wave beyond which the flow velocity returns to subsonic. It is advantageous to use a smoothly and gradually divergent passage 14 from the throat 26 to the inlet manifold and preferably also a divergent inlet manifold as shown since sonic flow conditions can then be sustained at the throat for a wider range of manifold vacuum. Sonic flow conditions can be achieved up to 90% of full power operation by correct design of the flow passages.

The shock wave in the divergent passage creates an area of great turbulence which assists atomization and mixing of the mixture. The turbulence in the mixture continues into the combustion chamber and there further improves combustion.

The improved homogenity and turbulence of the mixture allows a leaner mixture to be used. The carburetor would then have a smaller main fuel metering jet than if it operated in the conventional fixed jet fashion without the throttle body. The leaner mixture improves economy and reduces exhaust emission.

While the invention has been shown and described in its preferred embodiment, it will be clear that many changes and modifications may be made thereto without departing from the scope of the invention.

I claim:

1. A variable venturi carburetor having an induction passage communicating with ambient air at one end and adapted to be connected to an engine inlet manifold at the opposite end, the induction passage having a fixed area venturi defined by a fixed area choke, the passage converging upstream of the choke and diverging downstream of the choke, a main fuel passage extending into the induction passage and communicating with a fuel discharge tube which extends axially along the choke, an elongated throttle body supported at its upstream end by engagement with the fuel tube for a sliding movement in the induction passage, a throttle control device arranged for supporting the downstream end of the throttle body for a sliding movement and for displacing the throttle body between an idle speed position and a full throttle position downstream of the idle speed position, the throttle body having a divergent portion merging into a convergent portion, the throttle body in its idle speed position closely fitting the induction passage, displacement of the throttle body towards the full throttle position opening a variable throat between the widest part of the throttle body and the divergent portion of the induction passage, the throttle body having internal passages connecting the fuel tube to the widest part of the throttle body for discharge of fuel into the variable throat, the fuel tube being formed with a number of openings in its wall, the openings being just below the exit of the main fuel passage and communicating with the fixed choke flow area, the openings being sufficiently large that the pressure in the fixed choke flow area determines the flow of fuel in the main fuel passage.

2. A variable venturi carburetor having an induction passage communicating with ambient air at one end and adapted to be connected to an engine inlet manifold at the oposite end, the induction passage having a fixed area venturi defined by a fixed area choke, the passage converging upstream of the choke and diverging downstream of the choke, a main fuel passage extending into the induction passage and communicating with a fuel discharge tube which extends axially along the choke, an elongated throttle body supported at its upstream end by engagement with the fuel tube for a sliding movement in the induction passage, a throttle control device arranged for supporting the downstream end of the throttle body for a sliding movement and for displacing the throttle body between an idle speed position and a full throttle position downstream of the idle speed position, the throttle body having a divergent portion merging into a convergent portion, the throttle body in its idle speed position closely fitting the induction passage, displacement of the throttle body towards the full throttle position opening a variable throat between the widest part of the throttle body and the divergent portion of the induction passage, the throttle body having internal passages connecting the fuel tube to the widest part of the throttle body for discharge of fuel into the variable throat, the fuel tube being formed with a number of openings in its wall, the openings being just below the exit of the main fuel passage and communicating with the fixed choke flow area, the openings being sufficiently large that the pressure in the fixed choke flow area determines the flow of fuel in the main fuel passage, the throttle control device comprising a throttle shaft extending across the induction passage and passing between legs formed in the downstream end of the throttle body, and a lever mounted on the throttle shaft within the induction passage for connecting the shaft to the throttle body.

3. A carburetor as in claim 2 in which the legs of the throttle body straddle the lever.

4. A carburetor as in claim 3 in which the lever is connected to the throttle body by a link.

5. A carburetor as in claim 4 including a transfer opening just upstream of the idle throat section and connected to the idle system.

* * * * *